US006810896B2

(12) United States Patent
Ueda et al.

(10) Patent No.: US 6,810,896 B2
(45) Date of Patent: Nov. 2, 2004

(54) INFLATABLE TENT

(75) Inventors: Shigeru Ueda, Funabashi (JP); Masahiro Kusayama, Kurobe (JP)

(73) Assignee: YKK Corporation, Tokyo (JP)

( * ) Notice: Subject to any disclaimer, the term of this patent is extended or adjusted under 35 U.S.C. 154(b) by 15 days.

(21) Appl. No.: 10/288,538

(22) Filed: Nov. 6, 2002

(65) Prior Publication Data

US 2003/0116182 A1 Jun. 26, 2003

(30) Foreign Application Priority Data

Dec. 20, 2001 (JP) ..... 2001-388222

(51) Int. Cl.[7] ..... E04H 15/36
(52) U.S. Cl. ..... 135/136; 135/88.18; 135/124
(58) Field of Search ..... 135/134, 136, 135/137, 116, 117, 115, 88.12, 88.18, 88.13; 52/2.17, 2.18

(56) References Cited

U.S. PATENT DOCUMENTS 4,000,749 A * 1/1977 Busco ..... 600/21
4,335,545 A * 6/1982 Couch ..... 52/2.19
4,629,182 A * 12/1986 Rader et al. ..... 482/35
4,819,389 A * 4/1989 Kihn ..... 52/2.21
5,394,897 A * 3/1995 Ritchey et al. ..... 135/124
5,620,396 A * 4/1997 Westphal ..... 482/35
5,641,192 A * 6/1997 Smith et al. ..... 296/100.06
5,893,238 A * 4/1999 Peacock et al. ..... 52/2.18
6,192,633 B1 * 2/2001 Hilbert ..... 52/2.18
6,263,617 B1 * 7/2001 Turcot et al. ..... 52/2.18
6,282,843 B1 9/2001 Shibaike et al.
6,311,709 B1 * 11/2001 Louie et al. ..... 135/125
6,565,405 B2 * 5/2003 Hsu et al. ..... 446/89
6,659,521 B2 * 12/2003 Hill et al. ..... 294/19.1

FOREIGN PATENT DOCUMENTS

JP 56-101025 8/1981
JP 6-51431 7/1994
JP 11-287056 10/1999

* cited by examiner

*Primary Examiner*—Anita King
*Assistant Examiner*—Amy J. Sterling
(74) *Attorney, Agent, or Firm*—Finnegan, Henderson, Farabow, Garrett & Dunner, L.L.P.

(57) ABSTRACT

An improved inflatable tent includes a plurality of inflatable hollow rounded units (1), each tent unit 1 including an outer sheet (4) and an inner sheet (5) connected to each other at their respective ends, a side sheet (6) connecting the outer sheet (4) and the inner sheet (5) along their opposed sides, the side sheet (6) constituting a connecting portion (9), and a floor sheet (8) integrally connected to the lower end of the inner sheet (5). A pair of outer and inner water-impervious slide fasteners (10) are mounted between each pair of adjacent tent units (1) along the outside and insider thereof for joining the pair of adjacent tent units (1) of the tent.

7 Claims, 12 Drawing Sheets

INFLATABLE TENT

BACKGROUND OF THE INVENTION

1. Field of the Invention

This invention relates to a tent, particularly to a sectional inflatable tent which is comprised of a plurality of inflatable hollow rounded tent units, the tent units being formed in various shapes, so that combination of the various tent units permits the formation of tents as a whole in various shapes with the greatest ease.

2. Description of the Related Art

Heretofore, a plurality of tent units each with an A or triangle-shaped cross section are connected together by means of closing slide fasteners mounted along the side edges of the tent units to thus provide an elongated tent. This type of tent is shown, for example, in Japanese Laid-open Publication No. 56-101025 and Japanese Laid-open Publication no. 6-51431. Furthermore, Japanese laid-open Patent Publication No. 11-287056 (which corresponds to U.S. Pat. No. 6,282,843B1) shows a 3-dimentional pneumatic structure unit in dual-sheet configuration, comprised of a pair of inner and outer sheets defining therebetween a plurality of air compartments and adapted to be inflated with pressurized gas, and a pneumatic structure assembly comprised of a plurality of such units arranged in a row, each adjacent unit being separably connected to each other.

The tent units and the pneumatic structure units disclosed in the above related arts are of definite shapes, respectively, so that the tents and the pneumatic structure assembly formed by assembling of the above-mentioned tent units and pneumatic structure units, respectively, are also limited to a definite shape, also. Furthermore, the pneumatic structure is of large size, and are intended to be used on a construction site, or an operation site for installing or repairing large machinery, or to be used as a temporary pavilion for an exhibition or a public fair. Consequently, when joining separate pneumatic structure units together, the units must be compressed into contact with each other with enough strength in order to completely prevent rainwater from flowing inward through gaps between adjacent units. In order to achieve this, the units are connected together by means of fastening devices such as binding braids or eyelets; however, certain connecting condition must be met for full prevention of the influx of rainwater. Furthermore, such fastening means are not provided along the full periphery of the pneumatic structure unit, so that it is extremely difficult to keep the joint planes of the units uniformly water-impervious over the full periphery.

With the following problems in view, it is an object of the present invention to provide a sectional inflatable tent for recreation, leisure-time amusement etc. comprised of a plurality of inflatable hollow rounded tent units, joined together both on the outside and inside of the tent units by water-impervious slide fasteners, so that the tents are dually prevented from an influx of rainwater, and whereby the sectional inflatable tent can be fully prevented from influx of rainwater regardless of the conditions which the tent may be subjected to.

It is another object of the present invention to provide a sectional inflatable tent comprised of a plurality of inflatable hollow rounded tent units selected from a group of tent units of various shapes, so that the joining of such various shaped tent units will permit the erection of a tent of various shapes with great ease.

It is still another object of this invention to provide a sectional inflatable tent wherein a floor mat can be easily attached to the tent, making the tent habitable.

It is still another object of this invention to provide a sectional inflatable tent wherein a hanging hook is provided at the ceiling of the tent so as to suspend various appliances such as lanterns, portable radios, so that life in the tent is made more pleasant.

It is yet another object of this invention to provide a sectional inflatable tent that can be retained on the ground in stable condition even under the severe weather conditions, such as strong winds.

It is still another object of this invention to provide a sectional inflatable tent wherein a door body is hinged on the upper edge of a door opening formed in the tent so as to swing up open thereon for easy access to the inside of the tent, and furthermore the door body enjoys water-imperviousness.

It is yet another object of this invention to provide a sectional inflatable tent wherein the door body can be closed very easily and, once closed, can keep closed and stable in severe conditions.

It is still another object of this invention to provide a sectional inflatable tent wherein the door body can be kept open for ventilation.

It is still another object of this invention to provide a sectional inflatable tent wherein a window body is hinged on the upper edge of a window opening formed in the tent so as to swing up open thereon for easier ventilation of the tent and further the window body enjoys water-imperviousness.

It is another object of this invention to provide a sectional inflatable tent wherein draining function can be simply attained in the window and the window body can be opened and closed easily.

It is another object of this invention to provide a sectional inflatable tent wherein mosquito nets are provided both on the door openings and the window openings so that mosquitoes and other insects can be shut off with air-permeability enjoyed, hence providing a more pleasant atmosphere in the tent.

SUMMARY OF THE INVENTION

In accordance with the present invention, an inflatable tent comprises a plurality of inflatable hollow rounded tent units. Each tent unit includes an outer sheet, an inner sheet connected to each other at their respective ends, a side sheet connecting said outer sheet and said inner sheet along their opposed sides, said side sheet constituting a connecting portion, and a floor sheet integrally connected to the lower end of said inner sheet. The inflatable tent further includes a pair of outer and inner water-impervious slide fasteners, adapted for joining each pair of adjacent tent units along the outside and the inside, respectively, of said tent. Each of said slide fasteners has a separable end stop on one end thereof and includes a pair of stringers. Each stringer of said outer slide fastener is mounted on said connection portion along its side edge in proximity to said outer sheet and adapted for engagement with the other stringer of said outer slide fastener of an adjacent tent unit, and each stringer of said inner slide fastener is mounted on said connection portion along its side edge in proximity to said inner sheet and along the edge of said floor sheet, and adapted for engagement with the other stringer of said inner slide fastener of said adjacent tent unit.

Said plurality of hollow rounded tent units may be selected from the group consisting of a semi-dome-shaped tent unit, a semi-circular tent unit, an arc-shaped tent unit and a node tent unit, whereby one can erect said tent as a whole in various shapes by selecting and joining said tent units as desired. Said each tent unit may have a port for inflating and deflating said tent unit. Said stringer of said outer slide fastener and said stringer of said inner slide fastener may be uniform in length, respectively.

Many other advantages and features of the present invention will become manifest to those versed in the art upon making reference to the detailed description and the accompanying sheets of drawings in which preferred structural embodiments incorporating the principles of the present invention are shown by way of illustrative example.

DRAWINGS

Reference Numerals

Figure 1:
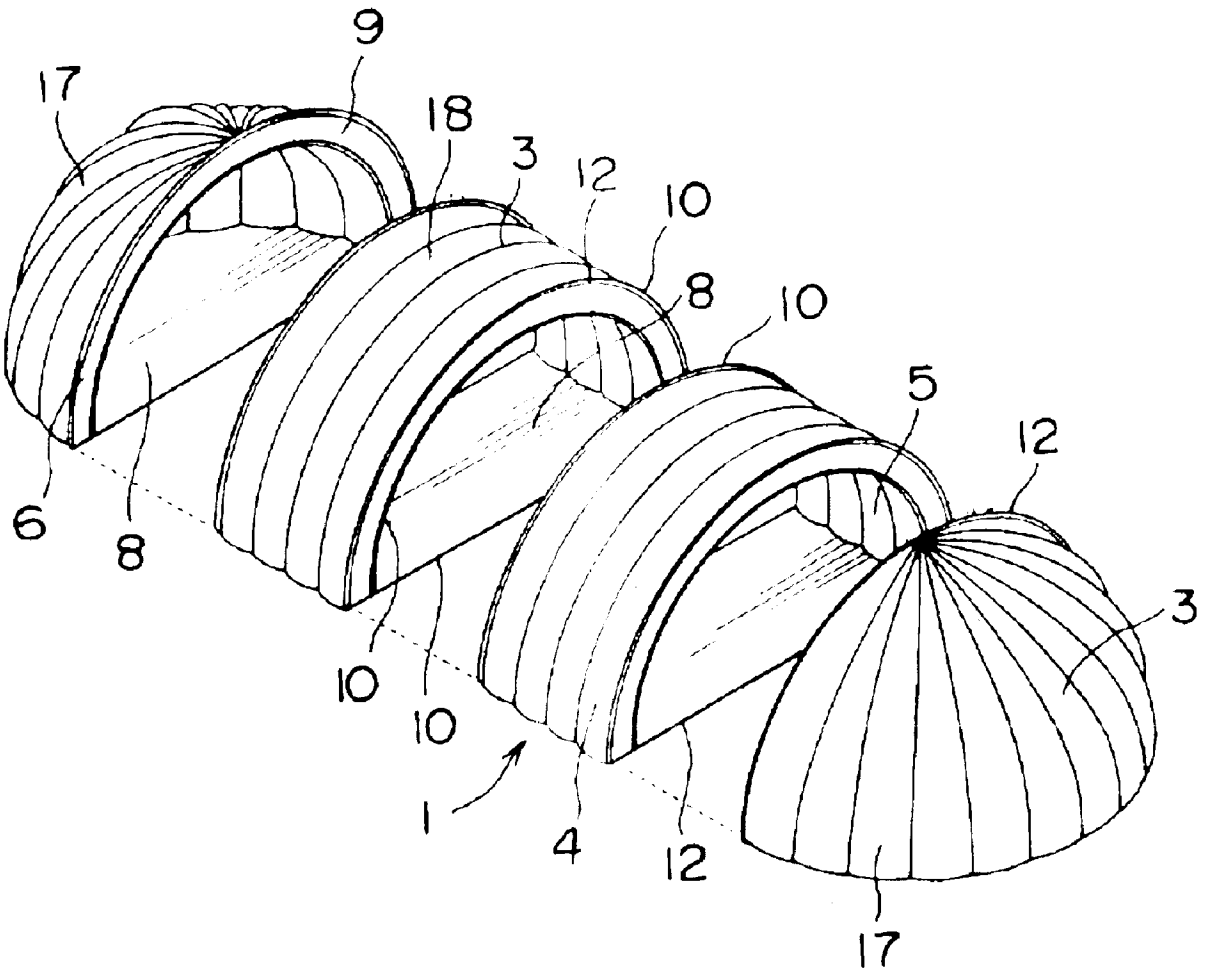
FIG. 1 is an exploded perspective view of a sectional inflatable tent according to the present invention, comprised of two semi-dome-shaped tent units and two semi-circular tent units.

1 Inflatable hollow rounded tent unit
3 Hollow structure
4 Outer Sheet
5 Inner sheet
6 Side sheet
7 Partition sheet
8 Floor sheet
9 Connecting portion
10 Water-impervious slide fastener
11 Surface fastener strip (or hook-and-loop fastener strip)
12 Stringer
13 Fastener tape
14 Fastener element
15 Air vent
16 Port
17 Semi-dome-shaped tent unit
18 Semi-circular tent unit
19 Arc-shaped tent unit
20 Node tent unit
21 Door body
22 Door opening
23 Hinge sheet
24 Door sill
25 Post grip
26 Supporting post
27 Anchor ring
28 Anchor bolt
29 Weight ring
30 Pull-tab
31 Roll up mosquito net
32 Hanging hook
33 Floor mat
35 Window body
36 Window opening
37 Lower edge (of window opening)
38 Lower edge (of window body)
40 Water-impervious coated layer

DETAILED DESCRIPTION OF THE INVENTION

Figure 2:
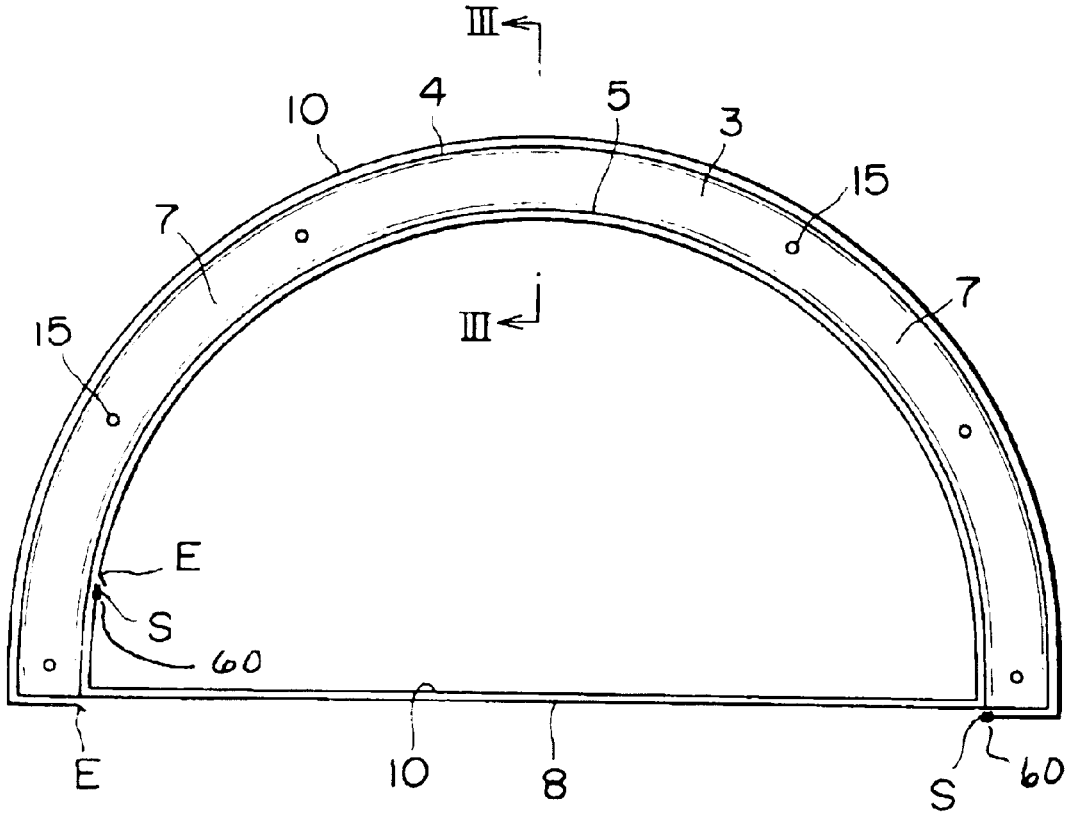
FIG. 2 is a diagrammatic view showing the path along which outer and inner water-impervious slide fasteners are arranged on a connection portion and a floor sheet of the tent unit.
Figure 3:
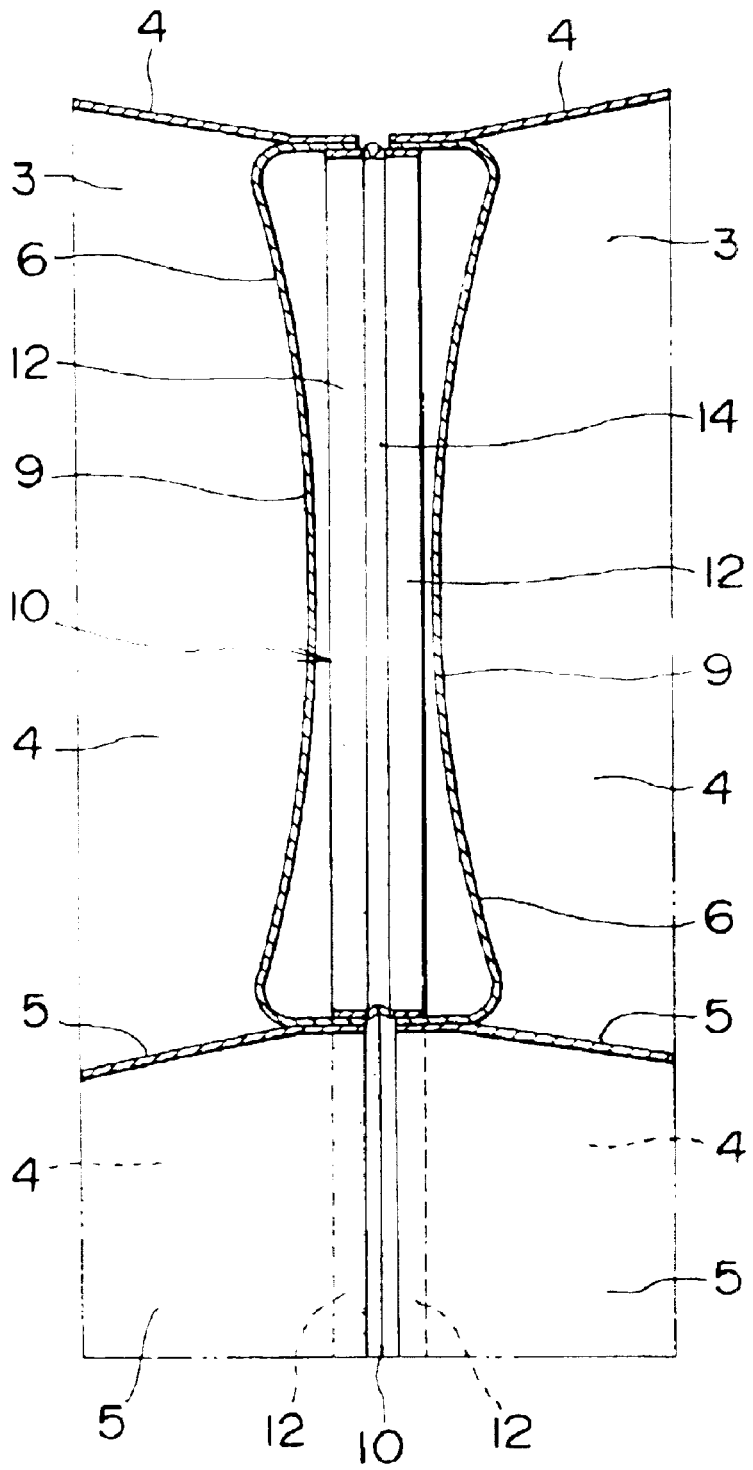
FIG. 3 is a cross-sectional view taken on line III—III of FIG. 2 to show the way the water-impervious slide fastener is arranged in order to join each adjacent tent units.
Figure 7:
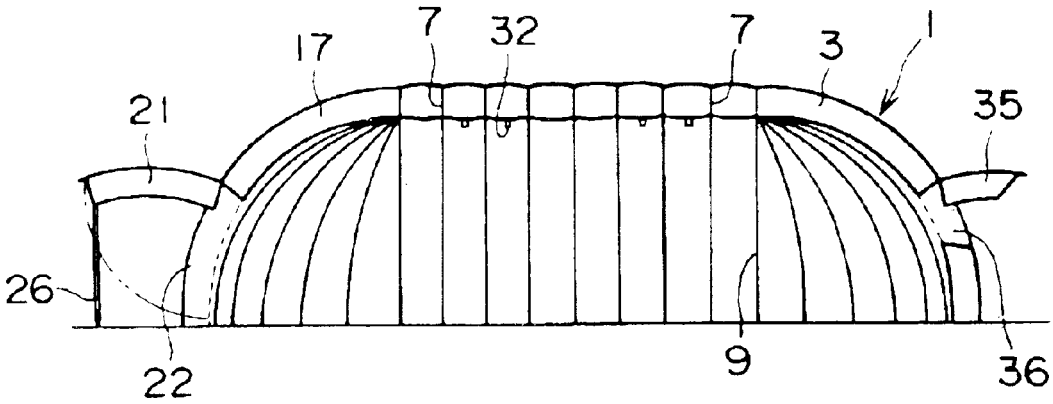
FIG. 7 is a cross-sectional view of the sectional inflatable tent of FIG. 5.

FIG. 1 shows an exploded perspective view of a sectional inflatable tent according to the present invention. The sectional inflatable tent is comprised of a plurality of inflatable hollow rounded tent units 1 each formed as a hollow structure 3. The tent units 1 may be of various shapes, specifically, they may be selected from the group consisting of a semi-dome-shaped tent unit 17, a semi-circular tent unit 18, an arc-shaped tent unit 19 and a node tent unit 20. As shown in FIG. 1, each hollow rounded tent unit 1 comprises an outer sheet 4 and an inner sheet 5 connected to each other at their respective lower ends, at least one side sheet 6 connecting the outer sheet 4 and the inner sheet 5 along their opposed sides. The side sheet 6 constitutes a connecting portion 9. A floor sheet 8 is integrally connected to the lower end of the inner sheet 5. As shown in FIGS. 2 and 7, in order to ensure that the outer sheet 4 and the inner sheet 5 be separated at a substantially uniform distance throughout the width of the tent unit 1, a plurality of partition sheets 7 are provided at intervals in such a manner to respectively connect the outer sheet 4 and the inner sheet 5, thus proving a plurality of air compartments.

Figure 4:
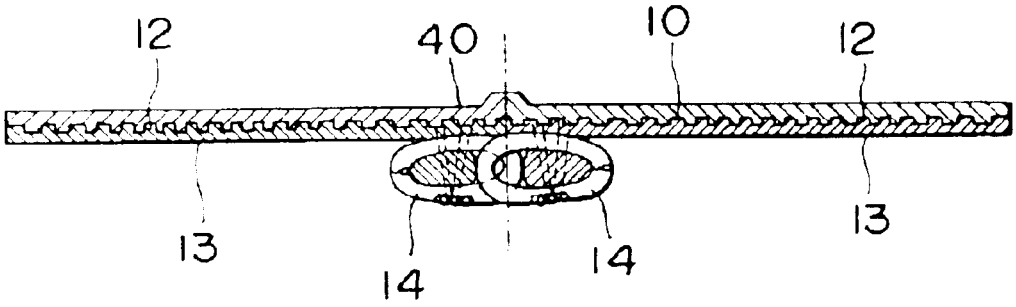
FIG. 4 is a cross-sectional view of the water-impervious slide fastener.

The various sheets used in the tent unit 1, such as the outer sheet 4, the inner sheet 5, the connecting sheet 6, the partition sheets 7 and the floor sheet 8 are all made of a woven or knitted fabric made of polyester-type or polyamide-type synthetic resinous yarns, and coated on either both sides or one side with thermoplastic resin such as polyurethane in order to provide water-imperviousness. The welding of the sheets may be carried out by ultrasonic welding method or other known methods. In order to join each adjacent tent units 1 together, a pair of outer and inner water-impervious slide fasteners 10 are used. As better shown in FIG. 4, each water-impervious slide fastener 10 comprises a pair of stringers 12. Each stringer 12 is comprised of a fastener tape 13 made of woven or knitted fabric made of polyester-type or polyamide-type synthetic resinous yarns and a row of coupling elements 14 mounted on a longitudinal marginal edge of the fastener tape 13 and adapted for coupling engagement with the mating row of coupling elements 14 mounted on the fastener tape 13 of the companion stringer 12. The fastener tape 13 is coated on its element-free surface with thermoplastic resin such as polyurethane to provide a water-impervious layer 40 over the tape surface. As shown in FIG. 4, the coated layer 40 slightly protrudes beyond the longitudinal marginal edge of the fastener tape 13 so that, when the fastener 10 comes into closed disposition, the protruding coated layers 40 of both stringers 12, 12 comes into pressing engagement with each other to the extent that they are bent up or raised away from the coupling element rows 14, so that the slide fastener 10 can enjoy water-imperviousness.

Depending on the application for which the sectional inflatable tent is used and the shape that the sectional inflatable tent assumes, the water-impervious slide fastener can be replaced by a watertight slide fastener which is superior in air-tightness and water-tightness to the water-impervious zipper, so that more watertight sectional inflatable tents can be provided.

Furthermore, the outer and inner slide fasteners 10 are of the separable type in the sense that the two stringers 12 can engage with and then fully separate from each other, so as to selectively assemble and disassemble the inflatable tent. To this end, each slide fastener 10 has a separable end stop 60 on one end of the lower end thereof. More specifically, the separable end stop 60 is comprised of a retainer box mounted at the lower end of the fastener element row of one of the mating stringers 12, a retainer pin extending up along the element row therefrom, and a separable pin mounted on the lower end of the fastener element row of the other stringer 12. The two coupling element rows of the slide fastener 10 are first engaged at their lower end portions by inserting the separable pin through a slider (not shown) and bringing the separable pin along the retainer pin into the retainer box. Substantially, the two stringers 12 are fully engaged by sliding the slider all the way along the two element rows up to the upper end, in a manner well known in this field. Each slide fastener 10 has a top end stop (not shown either) on the other or upper end in order to prevent the slider from leaving the slide fastener 10.

As stated earlier, each hollow rounded tent unit 1 comprises the outer sheet 4 and the inner sheet 5 connected to each other at their respective lower ends, at least one side sheet 6 connecting the outer sheet 4 and the inner sheet 5 along their opposed sides. The side sheet 6 constitutes the connecting portion 9. Each pair of adjacent hollow tent units 1, 1 are joined together along the outer and inner edges of the connection portion 9 by means of the outer and inner water-impervious slide fasteners 10, respectively. Specifically, each of the mating stringers 12 of the outer water-impervious slide fastener 10 is welded to the connecting portion 9 along its edge in proximity to the outer sheet 4, namely, along the region where the outer sheet 4 and the side sheet 6 are connected, with its element row facing inward of the tent unit. Each of the mating stringers 12 is adapted for engagement with the other stringer 12 of the outer water-impervious slide fastener 10 mounted along the corresponding edge of the connecting portion 9 of the adjacent tent unit 1. Each pair of adjacent tent units 1 is joined on its outer side, when the outer slide fastener 10 are closed by coupling the opposed element rows thereof by means of the slider.

Each of the mating stringers 12 of the inner water-impervious slide fastener 10 is welded to the connecting portion 9 along its edge in proximity to the inner sheet 5, namely, along the region where the inner sheet 5 and the side sheet 6 are connected, with its fastener element row facing outward of the tent unit 1. Each of the mating stringers 12 are adapted for engagement with the other stringer 12 of said inner water-impervious slide fastener 10 mounted along the corresponding edge of the connecting portion 9 of the adjacent tent unit 1. Each pair of adjacent tent units 1 are joined on its inner side, when the inner slide fastener 10 are closed by coupling the opposed fastener element rows thereof by means of the slider. Now, the adjacent tent units 1 are joined together by the outer and inner water-impervious slide fasteners 10 dually along both their outside and inside surfaces, respectively.

Description is then made as to the path in which the outer and inner water-impervious slide fasteners 10 are arranged, with reference to FIG. 2. As shown in FIG. 2, the outer slide fastener 10 welded to the connecting portion 9 along its edge in proximity with the outer sheet 4 starts at the point denoted by S and extends along the arch-like outer sheet 4 and ends at the point denoted by E. The outer fastener 10 is provided at the point S with the separable end stop 60 and at the point E with the upper end stop. The inner slide fastener 10 is welded to the connection portion 9 along its edge in proximity with the inner sheet 5 and along the edge of the floor sheet 8, similarly, starts at the point denoted by S, then extends along the arch-like inner sheet 5 and ends at the point denoted by E. The inner slide fastener 10 is also provided at the point S with the separable end stop 60 and at the point E with the upper end stop. As stated earlier, the outer sheet 4 and the inner sheet 5 are connected at desired intervals by the partition sheets 7. Each partition sheet 7 has air-vents 15 formed at predetermined positions for venting each adjacent air compartments.

Figure 5:
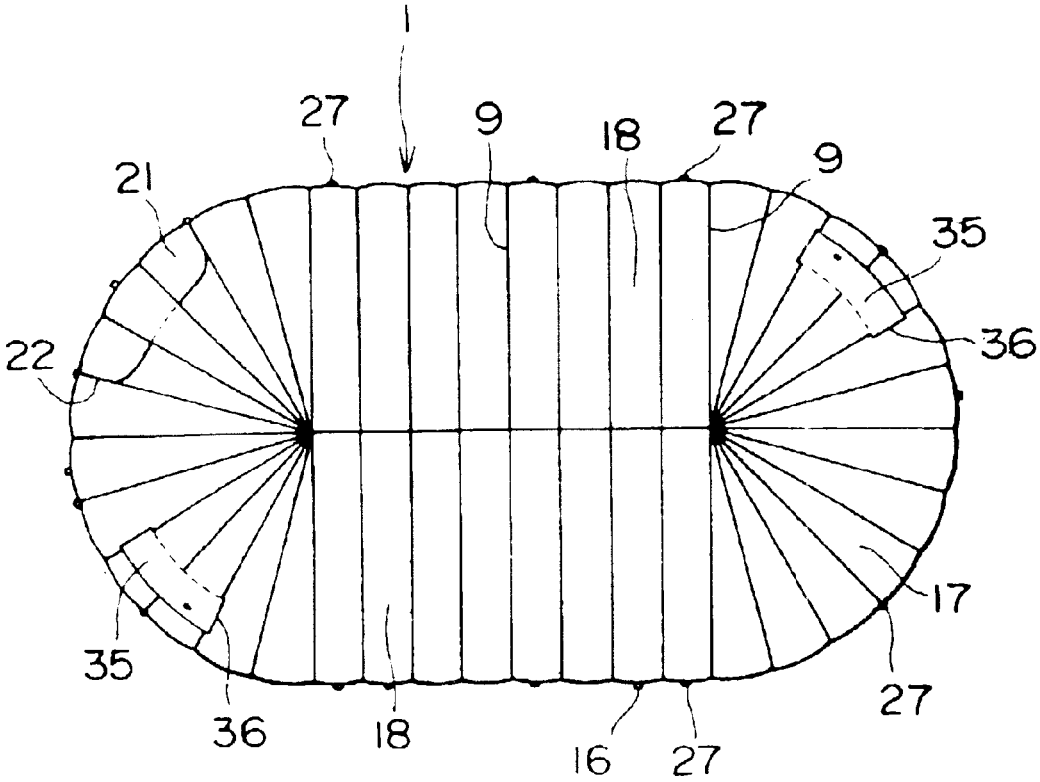
FIG. 5 is a plan view of the sectional inflatable tent of FIG. 1, but in assembled condition.
Figure 6:
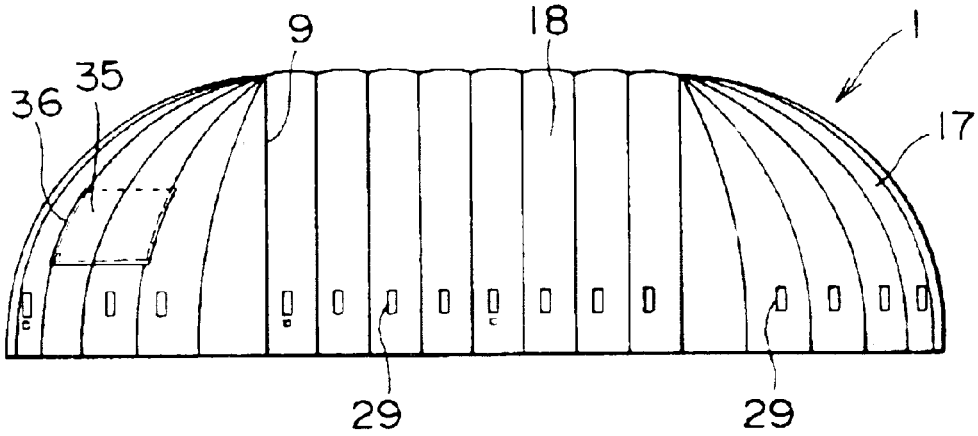
FIG. 6 is a front view of the sectional inflatable tent of FIG. 5.

If two semi-circular tent units 18 are first joined together and the two semi-dome-shaped tent units 17 are then joined to the opposed ends of the two joined semi-circular tent units 18, respectively, by means of the outer and inner slide fasteners 10, as shown in FIG. 1, then the air tent shown in FIGS. 5 and 6 is assembled. A door opening 22 may be formed in any tent unit 1 (the left semi-dome-shaped tent unit 17 as viewed in FIG. 5), and a door body 21 can be adapted for fitting engagement with the door opening 22. Furthermore, a window opening 36 may be formed in any tent unit 1 (the semi-dome-shaped tent units 17 placed on the opposed sides of the tent, as viewed in FIG. 5) and a window body 35 can be adapted for fitting engagement with the window opening 36.

Figure 8:
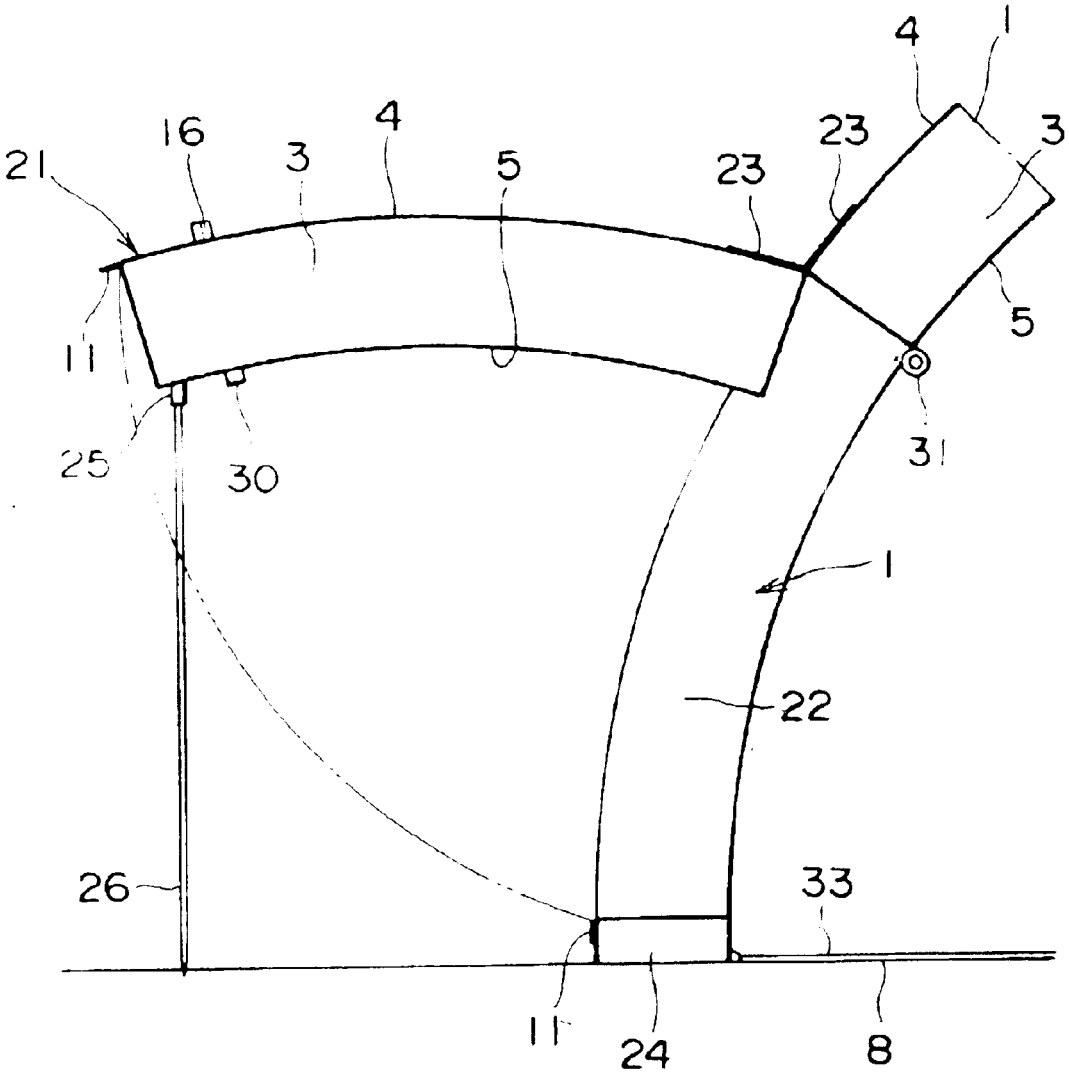
FIG. 8 is a fragmentary cross-sectional view of part of the sectional inflatable tent, showing a door opening and a door body associated therewith.

As best shown in FIG. 8, the door body 21 has a pair of outer and inner sheets 4, 5 and is hollow. The door body 21 is hinged by a hinge sheet 23 welded to the upper edge of the outer sheet 4 of the door body 21 and the outer sheet 4 of the tent unit 1 along the upper edge of the door opening 22, in order to open and close the door body 21. The door body 21 has an extension extended downwards from the lower edge of its outer sheet 4. Surface fastener strips or hook-and-loop fastener strips 11 are mounted on the rear surface of the extension at predetermined positions and are adapted for engagement with mating surface fastener strips 11 mounted at the corresponding positions on the outer surface of the door sill 24 formed below the door opening 22, when the door body 21 is closed.

One stringer 12 of an outer water-impervious slide fastener 10 is mounted along each of the opposed sides of the door opening 22 on the outer sheet 4 of the tent unit 1. The mating stringer 12 of the outer water-impervious slide fastener 10 is mounted along each of the opposed sides of the outer sheet 4 of the door body 21 and adapted for engagement with the stringer 12 of the outer slide fastener 10 of the door opening 22. Furthermore, one stringer 12 of an inner water-impervious slide fattener 10 is mounted along each of the opposed sides of the door opening 22 on the inner sheet 5. And the mating stringer 12 of the inner slide fastener 10 is mounted along each of the opposed sides of the inner sheet 5 of the door body 21 and adapted for engagement with the stringer 12 of the inner slide fastener 10 of the door opening 22. When the tent is occupied, only the inner slide fasteners 10 are used for opening and closing the door body 21, with the outer slide fasteners 10 kept open. Conversely, when the tent is not occupied, only the outer slide fasteners 10 are used for opening and closing the door body 21, with the inner slide fasteners 10 kept open.

The door body 21 has a post grip 25 mounted on the inner surface of the inner sheet 5 adjacent the lower edge thereof. A supporting post 26 sticks into the ground. The post grip 25 is adapted to securely hold the top of the supporting post 26 so as to keep the door body 21 open. A pull-tab 30 is mounted on the inner sheet 5 of the door body 21 for conveniently pulling the door body 21 inward when closing the door body 21.

A roll up mosquito net 31 is provided on the inner sheet 5 along the upper edge of the door opening 22. Surface fastener strips are provided on the mosquito net 31, along its opposed sides and free end. Mating surface fastener strips are provided on the inner sheet 5, along the opposed sides and the lower end of the door opening 22 and adapted for engagement with the surface fastener strips of the mosquito net 31, when the mosquito net 31 is unrolled down along the inner sheet 5, thus retaining the mosquito net 31 in closed disposition. The door body 21 has a port 16 provided on the outer sheet 4 for inflation and deflation thereof.

Figure 9:
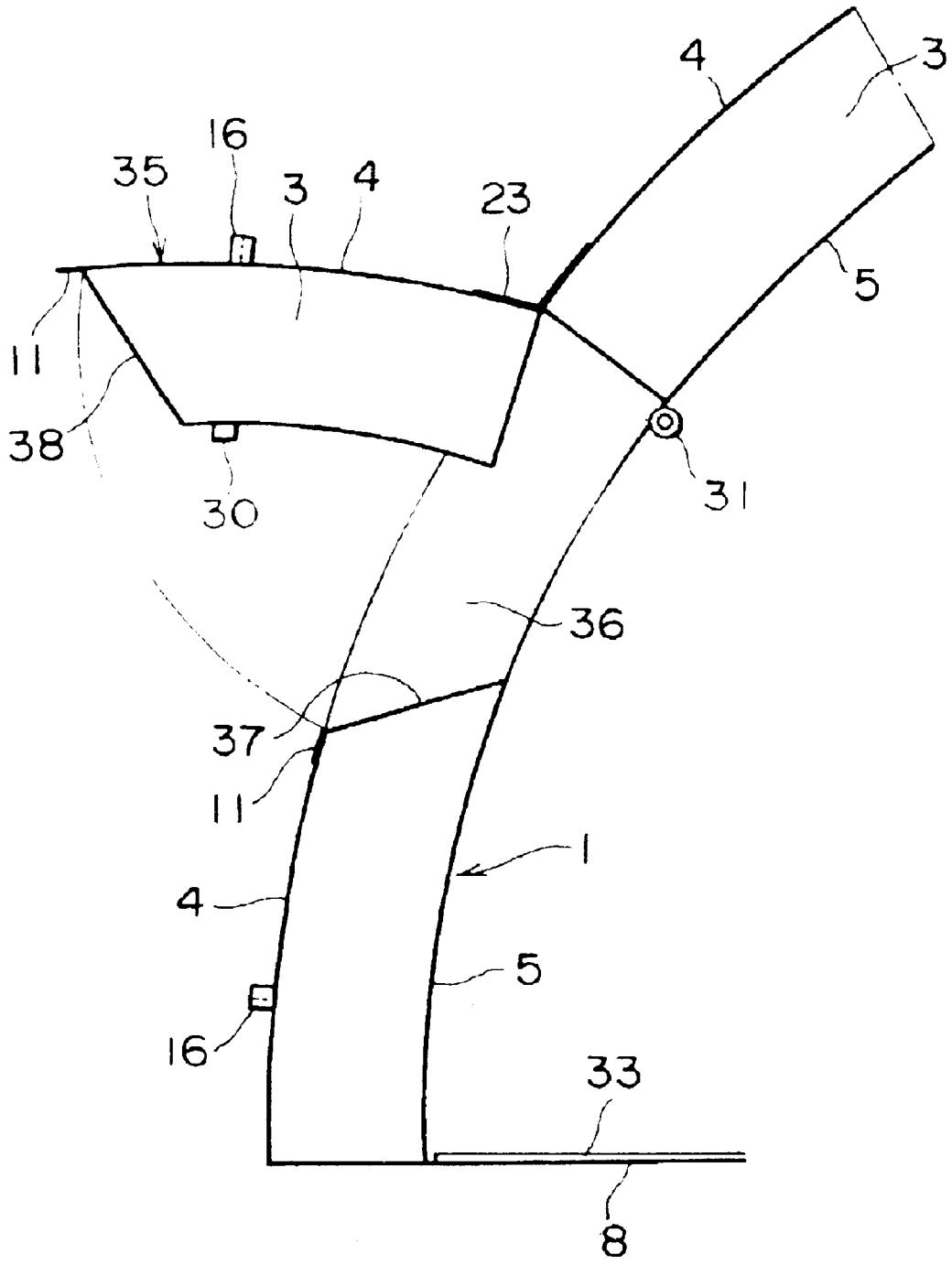
FIG. 9 is a fragmentary cross-sectional view of part of the sectional inflatable tent, showing a window opening and a window body associated therewith.

As shown in FIG. 9, the window body 35 has a pair of outer and inner sheets 4, 5 and is hollow. The window body 35 is hinged by a hinge sheet 23 welded to the upper edge of the outer sheet 4 of the window body 35 and to the outer sheet 4 on the upper edge of the window opening 36. The lower edge of the window opening 36 slants inwardly and outwards for better rainwater drainage. The window body 35 has an extension extended downwards from the lower edge of the outer sheet 4 of the window body 35. Surface fastener strips 11 are mounted on the rear surface of the extension at predetermined positions. The lower edge 38 of the window body 35 slants complimentarily with the slant of the lower edge 37 of the window opening 36 so that the lower edge of the window body 35 fits on the lower edge of the window opening 36 when the window body 35 is fully closed. One stringer 12 of a water-impervious slide fastener 10 is mounted along each of the opposed sides of the window opening 36 on the inner sheet 5 of the tent unit 1. The mating stringer 12 of the slide fastener 10 is mounted along each of the opposed sides of the inner sheet 5 of the window body 35 and adapted for engagement with the stringer 12 of the slide fastener 10 of the window opening 36. A pull-tab 30 is mounted on the inner sheet 5 of the window body 35 at the lower part for pulling the window body 35 inward for conveniently closing the window body 35.

A roll up mosquito net 31 is provided along the upper edge of the window opening 36 on the inner sheet 5. Surface fastener strips are provided on the mosquito net 31, along its opposed sides and free end. Mating surface fastener strips are provided on the inner sheet 5, along the opposed sides and the lower end of the window opening 36 and are adapted for engagement with the surface fastener strips of the mosquito net 31, when the mosquito net 31 is unrolled down along the inner sheet 5, thus retaining the mosquito net 31 in closed disposition. The window body 35 has a port 16 provided on the outer sheet 4 for inflating and deflating thereof.

Figure 10:
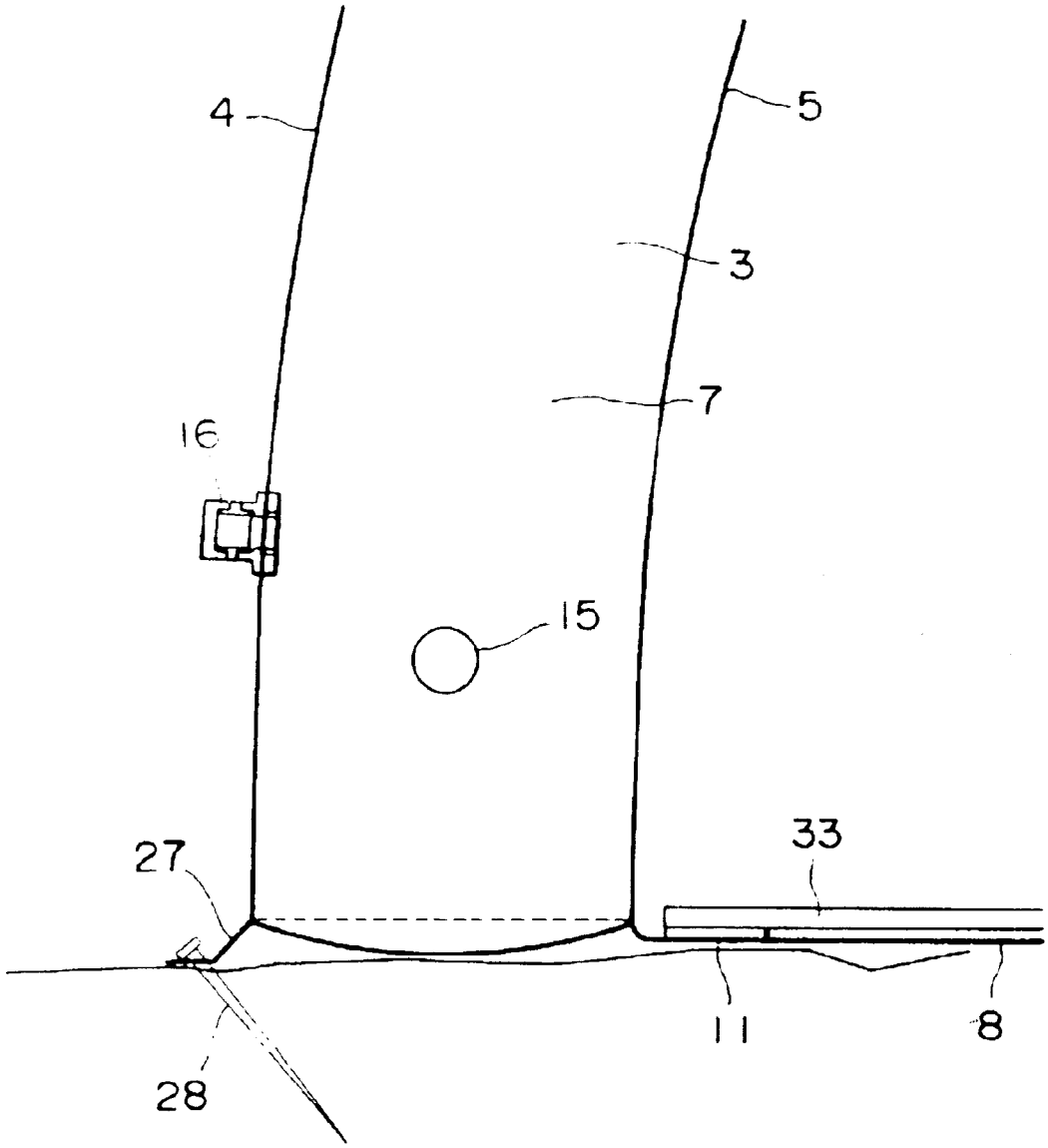
FIG. 10 is a fragmentary view of a tent unit, showing an anchor bolt and means for attaching a floor mat to a floor sheet of the tent unit.

As shown in FIG. 10, a port 16 is provided on the outer sheet 4 for intrusion into and extrusion from the air compartments of air thorough the air vents 15 formed in the partition sheets 7. Furthermore, surface fastener strips 11 are provided on the floor sheet 8 at its edge and adapted for engagement with the surfaces fastener strips 11 provided on the rear side of a floor mat 33 at their corresponding positions so as to firmly attach the floor mat 33 to the floor sheet 8. Alternatively, the surface fastener strips 11 may be provided on the inner sheet 5 along its lower edges to attach the floor mat 33 to the floor sheet 8. Moreover, anchor rings 27 are provided at the lower edge of the outer sheet 4 of the tent unit 1 and protrude outward. Anchor bolts 28 are inserted through the anchor rings 27 and stick into ground to securely hold the tent to the ground.

As shown in FIG. 6, each tent unit 1 of the inflatable tent is provided on its outer sheet 4 adjacent the lower edge with weight rings 29 for attaching thereto weights (not shown), which are intended to prevent the tent from being moved by stronger wind. Furthermore, as shown in FIG. 7, a hanging hook 32 is provided at or adjacent the ceiling of the tent unit 1 on the inner sheet 5 for suspending a portable radio, lantern, etc. therefrom.

Figure 11:
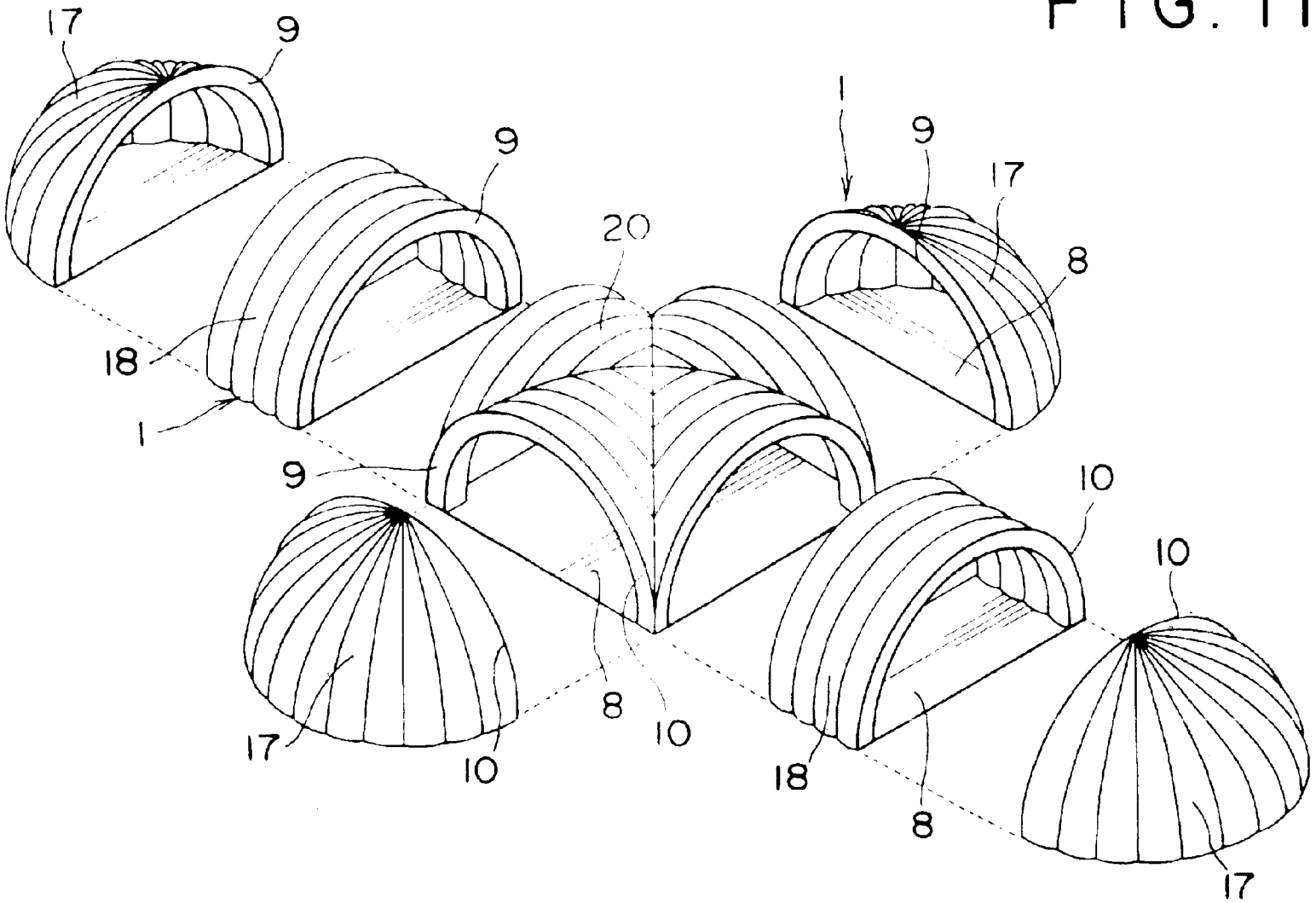
FIG. 11 is an exploded perspective view of a sectional inflatable tent in another shape, comprised of a node tent unit, two semi-circular tent units and four semi-dome-shaped tent units.
Figure 12:
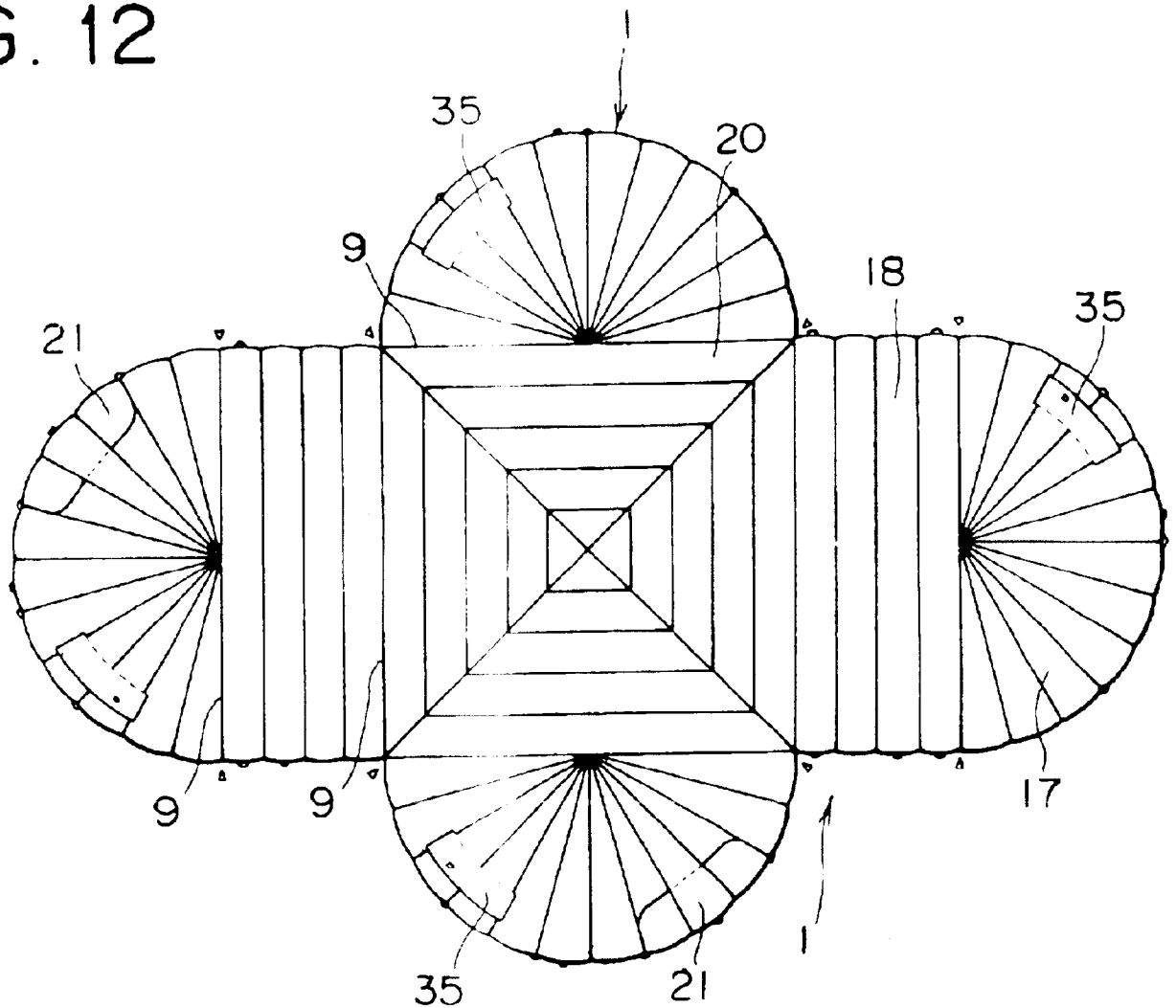
FIG. 12 is a plan view of the sectional inflatable tent of FIG. 11, but in assembled state.

The sectionable inflatable tent according to this invention can be provided in various shapes by combining any desired tent units 1 selected from the group consisting of a semi-dome-shaped tent unit 17, a semi-circular tent unit 18, an arc-shaped tent unit 19 and a node tent unit 20. For example, as better shown in FIG. 11, a node tent unit 20 appearing to be a square as viewed in FIG. 12 and having four connecting portions 9, one on each side, is placed first. Then, two semi-dome-shaped units 17 are directly joined one to each of one pair of opposed sides of the node tent unit 20. To each of the other pair of opposed sides of the node tent unit 20, a semi-dome-shaped unit 17 is joined with a semi-circular unit 18 interposed between the semi-dome-shaped unit 17 and the node unit 20, leading to erection of a sectional inflatable tent shown in FIG. 12. Each of the various tent units has the inner slide fastener 10 of the same type and the same length, and the outer slide fastener 10 of the same type and same length mounted on its connection portion 9 so as to ensure that it can be joined to any of the other tent units. The stringers 12 of each outer slide fastener 10 and the stringers 12 of each inner slide fastener 10 are uniform in length, respectively.

Figure 13:
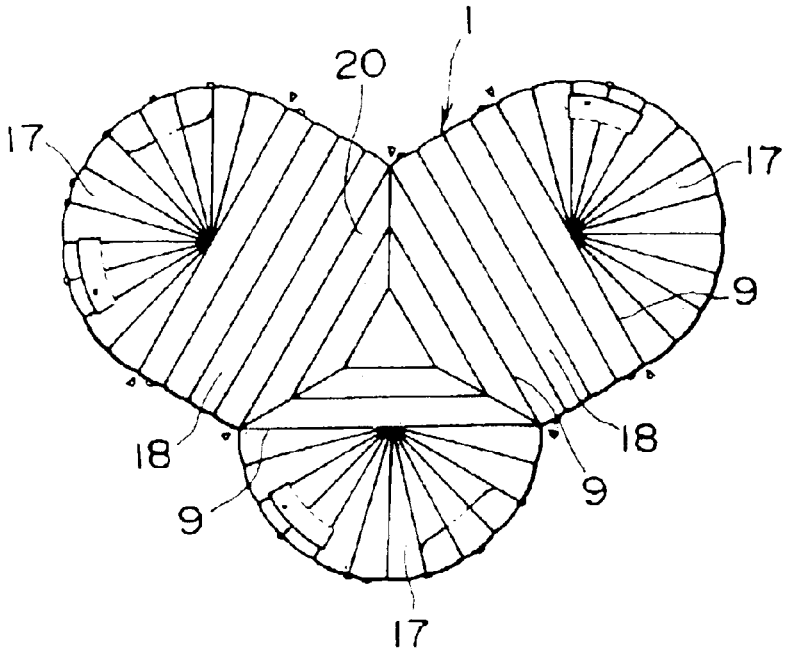
FIG. 13 is a plan view of a sectional inflatable tent in still another shape, comprised of a node tent unit, two semi-circular tent units and three semi-dome-shaped tent units, in assembled state.

As shown in FIG. 13, a node tent unit 20 is placed first. Unlike the node tent unit 20 in FIG. 12, the node tent unit 20 here appears to be triangular in shape as viewed in FIG. 13 and has three connecting portions 9, one on each side. A semi-dome-shaped tent unit 17 is connected directly to one of the sides of the triangular node unit 20. To each of the other two sides of the triangular node tent unit 20, a semi-dome-shaped unit 17 is joined, with a semi-circular unit 18 interposed between the semi-dome-shaped unit 17 and the node unit 20, thus leading to erection of an inflatable tent shown in FIG. 13.

Figure 14:
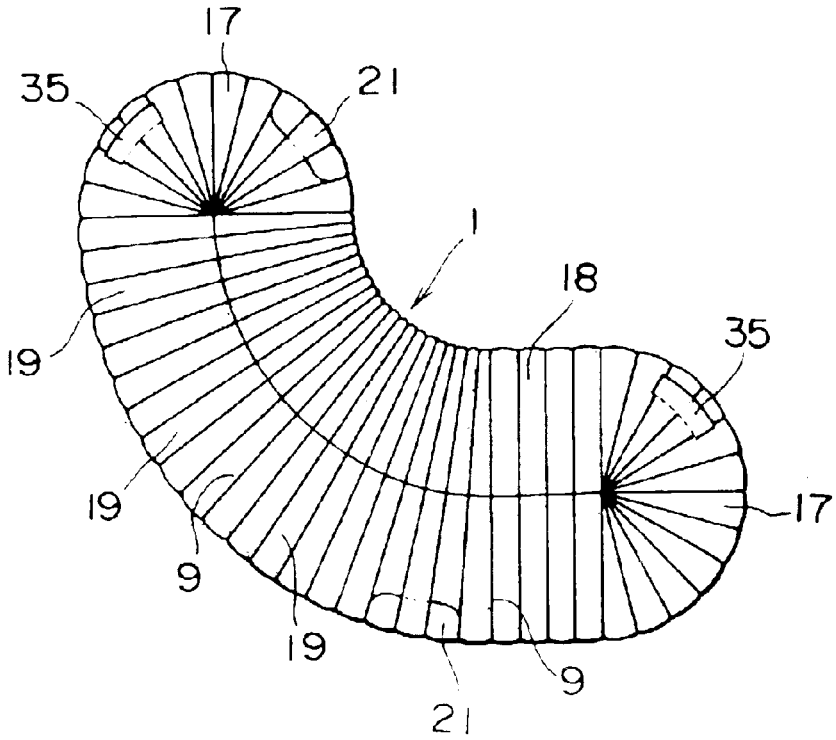
FIG. 14 is a plan view of a sectional inflatable tent in still another shape, comprised of one semi-circular-shaped tent unit, three arc-shaped tent units and two semi-dome-shaped tent units, in assembled state.

As shown in FIG. 14, a semi-dome-shaped tent unit 17 is first placed. Then, one semi-circular tent unit 18 is connected to the semi-dome-shaped tent unit 17. Then, four arc-shaped units 19 are connected to the semi-circular tent unit 18, one after another. Finally, a semi-dome-shaped unit 17 is connected to the last arc-shaped unit 19, thus leading to erection of an inflatable tent shown in FIG. 14.

Figure 15:
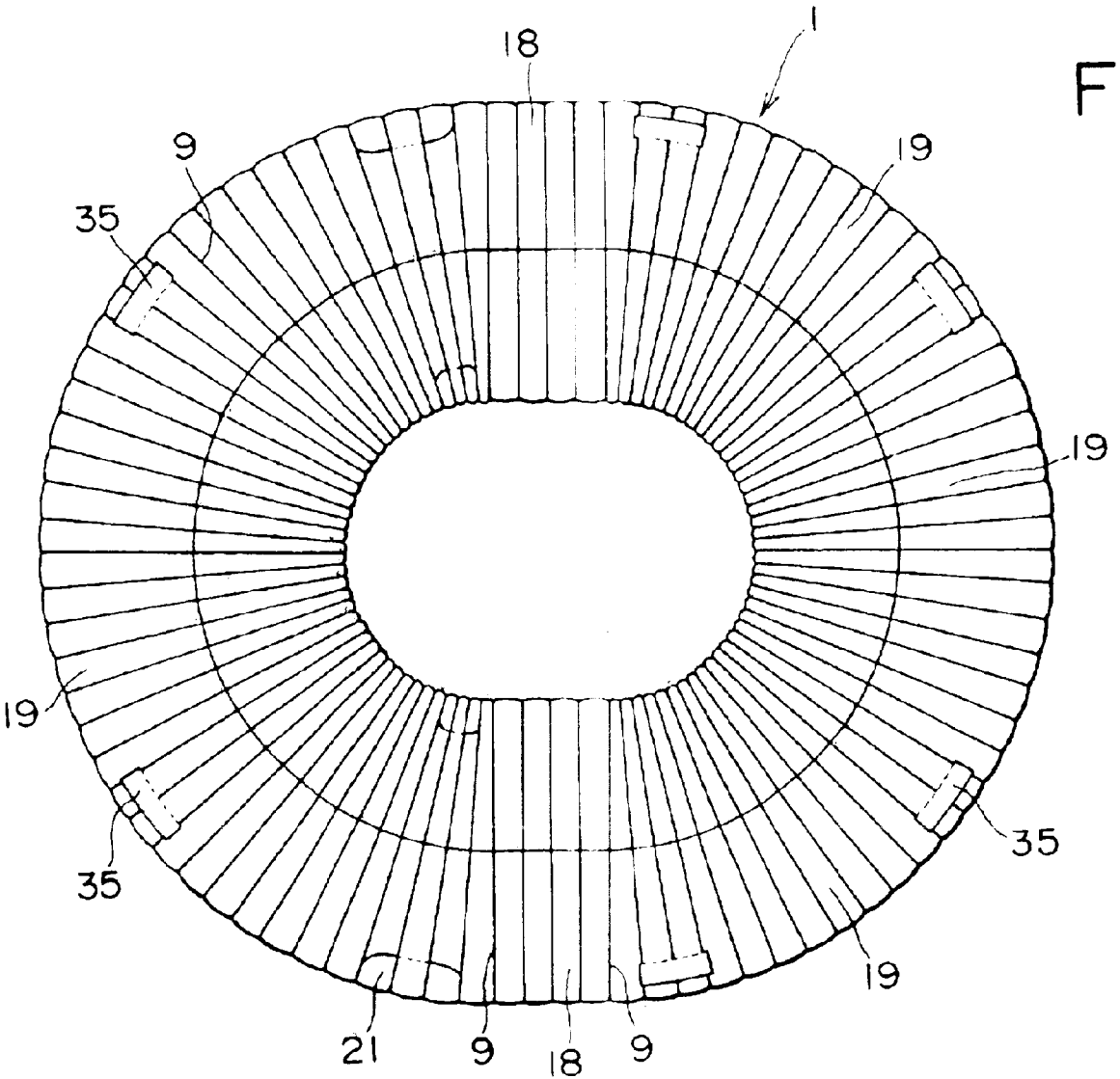
FIG. 15 is a plan view of yet another embodiment of the sectional inflatable tent comprised of two semi-circular-shaped tent units and several arc-shaped tent units, in assembled condition, providing a loop shape as a whole.

FIG. 15 shows an annular or loop-shaped tent. In order to correct this annular tent, two semi-circular tent units 18 are arranged diametrically opposed to each other. Then, several (16 shown FIG. 5) arc-shaped tent units 19 are arranged, eight on each side of the semi-circulate tent units 18, thus leading to erecton of the annular inflatable tent as shown in FIG. 5. By joinning various combination of tent units selected from the group consisting of a semi-dome-shaped tent unit 17, a semi-circular tent unit 18, an arc-shaped tent unit 19 and a node tent unit 20, one could easily errect an inflatable tent of various shapes.

Accordingly, the reader will see that the following effects result from the construction of the inflatable tent according to the present invention set forth above:

The inflatable tent of this invention can be set up with great ease by simply connecting the tent units, thus making the operations of, errection, transporting, assembling and disassembling of the tent very easy.

Each adjacent tent units are connected to the next unit along both outer and inner sides thereof by a pair of outer and inner water-impervious slide fasteners, so that the tent enjoys so-called "double-fence" protection against an influx of reinwater between the adjacent tent units, thus providing a completely water-proof tent.

One could select tent units of various shapes and assemble them in variious patterns, so that inflatable tents of various shapes can be constructed.

A floor mat is easily mounted in the tent, enhancing the amenity of living in the tent.

A hanging hook provided at the ceiling of the tent serves for suspending various articles, such as a lantern, a portable radio, etc., further making the tent life more pleasant.

The sectional inflatable tent is provided on its lower part with anchor rings, which are retained by anchor bolts to the ground. Furthermore, the tent is also provided with weight rings, to which weights are hooked, so that the tent can be securely retained stably on the ground even under the severe weather conditions, such as being blown by a strong wind.

The door body is hinged on the upper edge of a door opening formed in the tent so that the door body can be swung up and open to thus provide easy access to the tent. However, since the door body is provided on the inside and the outside with water-impervious slide fasteners, the door body enjoys sufficient water-and-air-imperviousness.

In addition to the slide fasteners, the door body can be retained in its closed position also by means of surface fasteners, and so can be kept closed in further stable condition.

Since the post grip provided on the rear surface of the door body securely holds the top of a support pole stuck vertically into the ground, the door body can keep open in stable condition for ventilation.

The window body is hinged on the upper edge of a window opening formed in the tent unit so that the window body can be readily swung up open for ventilation. However, since the window body is provided on the inside with water-impervious slide fasteners, the window body enjoys sufficient water-and-air-imperviousness.

The lower edge of the window opening and the lower edge of the window body slant outwardly and downwards, complimentarily with each other, so that the draining function can be simply attained and the window body can be opened and closed easily.

Mosquito nets are provided both on the door openings and on the window openings, so that mosquitoes and other harmful insects can be kept out of the tent but retaining air-permeability, thus providing a pleasant atmosphere within the tent.

Although the description above contains specificities, these should not be construed as limiting the scope of the invention but as merely providing illustrations of some of the present preferred embodiments of this invention.

Thus, the scope of the invention should be determined by the appended claims and their legal equivalents, rather than by the samples given.

The entire disclosure of Japanese Patent Application No. 2001-388222 filed on Dec. 20, 2001 including specification, claims, drawings and summary are incorporated herein by reference in its entirely.

What is claimed is:

1. An inflatable tent comprising:

a plurality of inflatable hollow rounded tent units, each tent unit including an outer sheet and an inner sheet connected to each other at their respective ends, a side sheet connecting said outer sheet and said inner sheet along their opposed sides, said side sheet constituting a connecting portion, and a floor sheet integrally connected to the lower end of said inner sheet; and a pair of outer and inner water-impervious slide fasteners adapted for joining each pair of adjacent tent units along the outside and the inside, respectively, of said tent, each of said slide fasteners having a separable end stop on one end thereof and including a pair of stringers, each stringer of said outer slide fastener being mounted on said connection portion along its side edge in proximity to said outer sheet and adapted for engagement with the other stringer of said outer slide fastener of an adjacent tent unit, and each stringer of said inner slide fastener being mounted on said connection portion along its side edge in proximity to said inner sheet and along the edge of said floor sheet, and adapted for engagement with the other stringer of said inner slide fastener of said adjacent tent unit; and wherein said tent unit has a door opening formed therein and a door body adapted for fitting engagement with said door opening, said door body having a pair of outer and inner sheets and being hinged by a hinge sheet connecting the upper edge of said outer sheet of said door body and the upper edge of said door opening, one stringer of an outer water-impervious slide fastener being mounted along each of the opposed sides of said door opening on said outer sheet of said tent unit and adapted for engagement with the other stringer of said outer water-impervious slide fastener mounted along each of the opposed sides of said outer sheet of said door body, and one stringer of an inner water-impervious slide fastener being mounted among each of the opposed sides of said door opening on said inner sheet of said tent unit and adapted for engagement with the other stringer of said inner water-impervious slide fastener mounted along each of the opposed sides of said inner sheet of said door body.

2. An inflatable tent according to claim 1, said door body has an extension extended from the lower edge of said outer sheet of said door body, said extension having a surface fastener strip mounted on the rear surface thereof and adapted for engagement with mating surface fastener strips mounted at predetermined positions on the outer surface of a door sill formed below said door opening, when said door body is closed, a pull-tab being mounted on said inner sheet of said door body.

3. An inflatable tent according to claim 1 or 2, wherein said door body has a post grip mounted on the inner surface of said inner sheet adjacent the lower edge, and adapted to securely hold a top of a supporting post sticking into the ground so as to keep said door body open.

4. An inflatable tent comprising:

a plurality of inflatable hollow rounded tent units, each tent unit including an outer sheet and an inner sheet connected to each other at their respective ends, a side sheet connecting said outer sheet and said inner sheet alone their opposed sides, said side sheet constituting a connecting portion, and a floor sheet integrally connected to the lower end of said inner sheet; and a pair of outer and inner water-impervious slide fasteners, adapted for joining each pair of adjacent tent units along the outside and the inside, respectively, of said tent, each of said slide fasteners having a separable end stop on one end thereof and including a pair of stringers, each stringer of said outer slide fastener being mounted on said connection portion along its side edge in proximity to said outer sheet and adapted for engagement with the other stringer of said outer slide fastener of an adjacent tent unit, and each stringer of said inner slide fastener being mounted on said connection portion along its side edge in proximity to said inner sheet and along the edge of said floor sheet, and adapted for engagement with the other stringer of said inner slide fastener of said adjacent tent unit; and wherein said tent unit has a window-opening formed therein and a window body adapted for fitting engagement with said window opening, said window body having a pair of outer and inner sheets and being hinged by a hinge sheet connecting the upper edge of said outer sheet of said window body and the upper edge of said window opening, one stringer of a water-impervious slide fastener being mounted along each of the opposed sides of said window opening on said inner sheet of said tent unit and adapted for engagement with the other stringer of said water-impervious slide fastener mounted along each of the opposed sides of said inner sheet of said window body; and wherein said window body has an extension extended from the lower edge of said outer sheet of said window body, said extension having a surface fastener strip mounted on the rear surface thereof and adapted for engagement with mating surface fastener strips mounted at predetermined positions on the outer surface of said outer sheet adjacent to a lower edge of said window opening, when said window body is closed.

5. An inflatable tent according to claim 4, wherein the lower edge of said window opening slants downwardly outwards, and the lower edge of said window body slants complementarily with the slant of the lower edge of said window opening 36, a pull-tab being provided on the inner surface of said inner sheet at said lower part of said window body.

6. An inflatable tent according to claim 1, wherein a roll up mosquito net is provided along the upper edge of said door opening on said inner sheet, said mosquito net having surface fastener strips provided on the outer surface, at its opposed sides and free end, and adapted for engagement with mating surface fastener strips provided along the opposed sides and the lower end of said door opening on said inner sheet when said mosquito net is unrolled down, thus retaining said mosquito net in closed disposition.

7. An inflatable tent according to claim 4, wherein a roll up mosquito net is provided along the upper edge of said window opening on said inner sheet, said mosquito net having surface fastener strips provided on the outer surface, at its opposed sides and free end, and adapted for engagement with mating surface fastener strips provided along the opposed sides and the lower end of said window opening on said inner sheet when said mosquito net is unrolled down, thus retaining said mosquito net in closed disposition.

* * * * *

UNITED STATES PATENT AND TRADEMARK OFFICE

CERTIFICATE OF CORRECTION

PATENT NO. : 6,810,896 B2
DATED : November 2, 2004
INVENTOR(S) : Shigeru Ueda and Masahiro Kusayama It is certified that error appears in the above-identified patent and that said Letters Patent is hereby corrected as shown below:

Title page,
Item [57], ABSTRACT,
Line 10, "insider" should read -- inside --.

Column 10,
Line 58, "among" should read -- along --.
Line 64, "claim 1, said" should read -- claim 1, wherein said --.

Column 11,
Line 16, "alone" should read -- along --.
Line 34, "window-opening" should read -- window opening --.

Signed and Sealed this

Fifteenth Day of February, 2005

JON W. DUDAS
*Director of the United States Patent and Trademark Office*